US005467669A

United States Patent [19]

Stroud

[11] Patent Number: 5,467,669

[45] Date of Patent: Nov. 21, 1995

[54] CUTTING TOOL INSERT

[75] Inventor: Donald S. Stroud, Montgomery, Tex.

[73] Assignee: American National Carbide Company, Tomball, Tex.

[21] Appl. No.: 417,435

[22] Filed: Apr. 5, 1995

Related U.S. Application Data

[63] Continuation-in-part of Ser. No. 56,833, May 3, 1993, abandoned.

[51] Int. Cl.[6] ..... B21K 5/02

[52] U.S. Cl. ..... 76/108.2; 175/426

[58] Field of Search ..... 76/108.2, 108.1, 76/108.4, DIG. 71, DIG. 12; 175/426

[56] References Cited

U.S. PATENT DOCUMENTS

| | | | |
|---|---|---|---|
| 2,842,342 | 7/1958 | Haglund . | |
| 2,888,247 | 5/1959 | Haglund . | |
| 2,889,138 | 6/1959 | Haglund . | |
| 3,693,736 | 9/1972 | Gardner | 175/426 |
| 4,339,009 | 7/1982 | Busby | 175/426 |
| 4,705,124 | 11/1987 | Abrahamson et al. . | |
| 4,729,603 | 3/1988 | Elfgen . | |
| 4,743,515 | 5/1988 | Fischer et al. . | |
| 4,854,405 | 8/1989 | Stroud . | |
| 4,907,665 | 3/1990 | Kar et al. . | |
| 5,074,623 | 12/1991 | Hedlund et al. . | |
| 5,154,245 | 10/1992 | Waldenstrom et al. . | |

FOREIGN PATENT DOCUMENTS

| | | | |
|---|---|---|---|
| 2041427 | 9/1980 | United Kingdom | 175/426 |

*Primary Examiner*—James G. Smith
*Attorney, Agent, or Firm*—Vaden, Eickenroht, Thompson & Feather

[57] ABSTRACT

A hard metal insert for a drill bit is disclosed having an outer body and an encapsulated inner body. The particle size and the chemical composition of the outer body and the inner body are such that the outer body is harder and more wear resistant than the inner body and the inner body is tougher than but not as hard as the outer body. The dimension of the outer body is approximately of equal thickness to the inner body at the cutting surface of the insert to ensure maintaining even wear. A method for forming a hard metal insert is also disclosed comprising creating an inner body mixture of a carbide material with a binder material, creating an outer body mixture of a carbide material with a binder material, compressing the inner body mixture to form the inner body, compressing the outer body mixture around the inner body such that the insert formed has an outer body of approximately equal thickness around the inner body at the cutting surface and sintering the inner and outer bodies so as to create a blending of the homogeneous materials of the two bodies without having any separation therebetween or an interface layer.

7 Claims, 2 Drawing Sheets

CUTTING TOOL INSERT

This application is a continuation-in-part of application Ser. No. 08/056,833, filed May 3, 1993.

BACKGROUND OF THE INVENTION

1. Field of the Invention

The present invention relates generally to cutting tool inserts of the type utilized in the drilling, mining, and construction industries. In particular, the present invention relates to improvements in wear resistant inserts which are adapted to be installed on the face of a cutting tool and which are formed of particles of carbide or other highly abrasive material sintered in a binder of cobalt or other less abrasive, but tougher metal.

2. Description of the Prior Art

In the drilling of oil and gas wells, drill bits are installed at the lower end of a rotary drill string for cutting through rock and other hard formations. These bits, which may, for example, be of a tri-cone rotary type or a percussion type, have inserts of wear resistant material installed on the cutting faces of the bit by press fit or by being cemented in place such that their outer ends project from the face of the bit body to provide the wear surfaces of the bit.

The inserts are available in different "grades" depending on the particle sizes and/or chemical composition, whereby the user is able to choose between relatively hard, but more brittle, or less hard, but tougher, inserts. The wear surfaces on the outer ends of the inserts are so contoured to define a tip. These surfaces may be rounded or conical with the tip located in the center of the outer end of the insert (dome-type), or, depending on the use to which the bit is to be put, may be flat along opposite sides of a tip which extends laterally across its outer end (chisel-type). As the insert is worn, the tip forms flats which dull the cutting surfaces of the insert. As a result, the cutting rate of the insert is reduced and/or it may be necessary to prematurely remove the bit to permit the inserts to be replaced or resharpened.

Dual component inserts having a harder, more wear resistant portion and a less hard, but tougher portion have been made by positioning the different types of hard metal so that more of the tougher type is brought into the cutting surface of the insert as the cutting insert wears away. Such inserts are comprised of different zones or layers having variations in resistance to wear and in toughness. See U.S. Pat. Nos. 2,842,342, 2,888,247, and 2,889,138, for examples of such inserts. Such inserts tend to wear unevenly, reducing the effective life of the insert. Furthermore, such inserts require piecing the inserts together by brazing or during the sintering process. Other inserts in the prior art employ a relatively thin layer of a harder grade of tungsten carbide on a relatively thicker base of a tougher carbide material as disclosed in U.S. Pat. No. 4,705,124. The harder grade of tungsten carbide forms the earth engaging face of the insert. The useful life of these rock bit inserts is limited by the relative thickness of the harder carbide material, with the effectiveness of the inserts being greatly reduced once the harder material has been worn to a blunt surface or completely removed by wear or fracturing during drilling.

Inserts having two or more components meeting at a mating plane are known as provided in U.S. Pat. No. 4,722,405. The insert is oriented in a cutting tool so that the tougher component is on the leading face of the insert, and the harder component defines the trailing face. Again, the insert tends to wear unevenly thereby reducing drilling efficiency as the harder carbide component is worn away.

It is therefore an object of this invention to provide a dual component insert which is of such construction that there is less tendency for it to become dull as it wears.

It is another object of this invention to provide a dual component insert which is of such construction that there is less tendency for it to wear unevenly.

These and other objects, advantages, and features of this invention will be apparent to those skilled in the art from a consideration of the attached drawings and appended claims.

SUMMARY OF THE INVENTION

The inventive hard metal insert disclosed herein has a base that is inserted into a socket or accommodating hole in a rotary drill bit, or a percussion or other drill bit and a tip that projects from the socket to form a cutting surface. The insert usually comprises an outer body or portion and an encapsulated inner body or core. The particle size and the chemical composition of the outer body and the inner body are such that the outer body is harder and more wear resistant than the inner body. This structure ensures that the general contour of the outer body is maintained during use. In a preferred embodiment of the invention, the outer body is comprised of tungsten carbide having an average grain size in the range of approximately 1 to 3 microns and approximately 6% by weight of cobalt. The inner body or core is comprised of tungsten carbide having an average grain size in the range of approximately 5 to 7 microns and approximately 10% by weight of cobalt. The encapsulated inner body makes up approximately 30% of the total weight of the insert.

The inventive method for forming a hard metal insert that is disclosed herein provides an insert with a base for insertion into a socket in a rotary or other drill bit such that its tip projects from the socket to form a cutting surface. Generally, the insert comprises an outer body and an encapsulated inner body. The insert is formed by creating an inner body mixture of a carbide material and a binder material, and an outer body mixture of a carbide material and binder material. The inner body mixture is compressed in the desired shape to form the inner body. The outer body mixture is compressed around the inner body such that the insert formed has an outer body of approximately equal thickness around the inner body at the cutting surface. The combination is then sintered so as the blend together the homogeneous materials of the inner and outer bodies so that there is no distinctive interface therebetween.

IN THE DRAWINGS

FIG. 1 view partly in elevation and partly in section of a tri-cone rotary drill bit having chisel-type inserts on the cutting faces of the cone, and showing the inner ends of the inserts held within holes in the cone face;

DETAILED DESCRIPTION OF THE INVENTION

Figure 1:
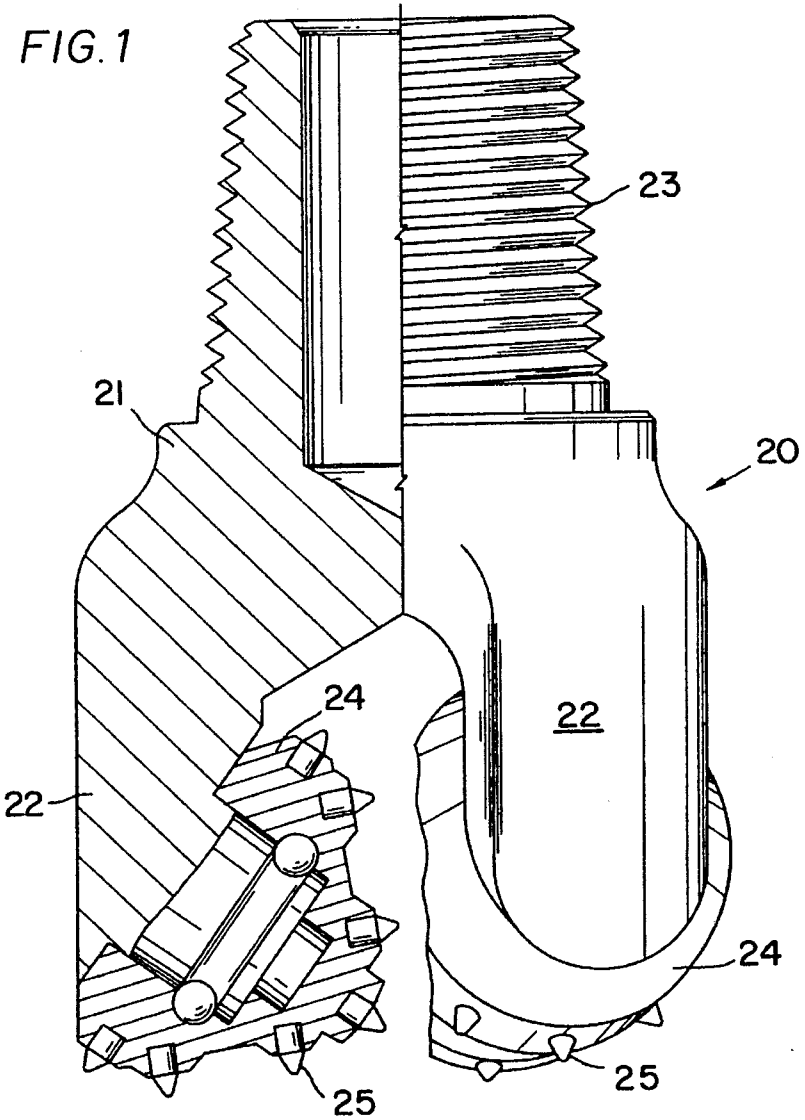

With reference now to details in the above-described drawings, the bit 20 shown in FIG. 1 comprises a bit body 21 having threads 23 at its upper end for connection to the lower end of a rotary drill string and legs 22 extending from its lower end. The legs support three roller cones 24 arranged in equally spaced relation for rotation about their axes as they rotate with the bit body. As shown in a broken away portion of FIG. 1, rows of chisel-type inserts 25 are installed on the cutting face of each cone with the base of each insert press fitted within a hole in the cone to dispose its cutting surface in position to cut away the bottom of the well bore as the bit is rotated with the drill string.

Figure 2:
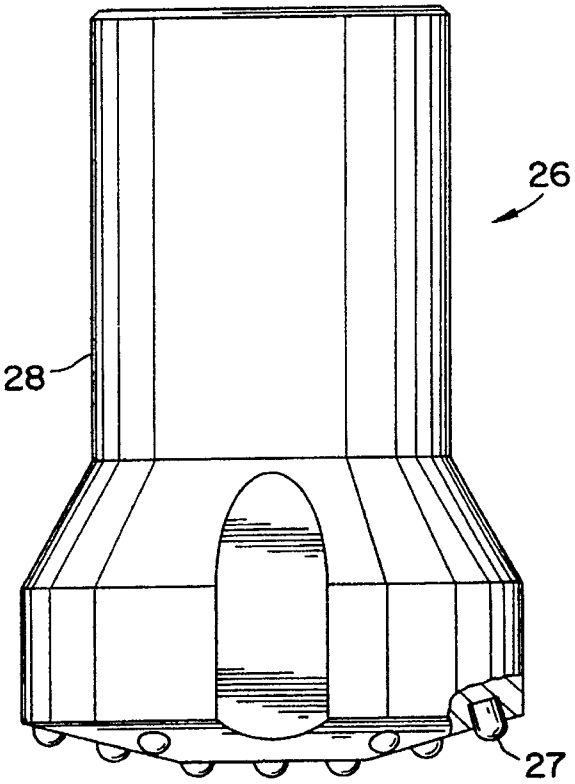
FIG. 2 is an elevational view of a percussion-type rotary drill bit having dome-type inserts installed on the face of the bit body.

In the percussion-type bit 26 shown in FIG. 2, dome-type inserts 27 are installed on the face of the lower end of the bit body 28, as by press-fitting within holes in the lower end of the bit body, as shown in a sectional portion of FIG. 1.

Figure 5:
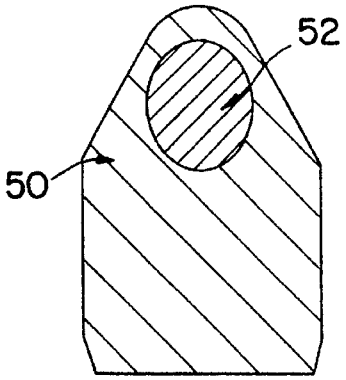
FIG. 5 is a longitudinal sectional view of a chisel-type insert fabricated in accordance with a third embodiment of the present invention.
Figure 6:
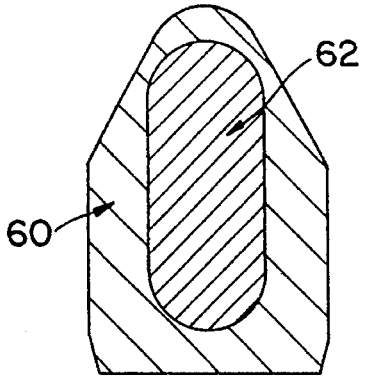
FIG. 6 is a longitudinal sectional view of a chisel-type insert fabricated in accordance with a fourth embodiment of the present invention.
Figure 7:
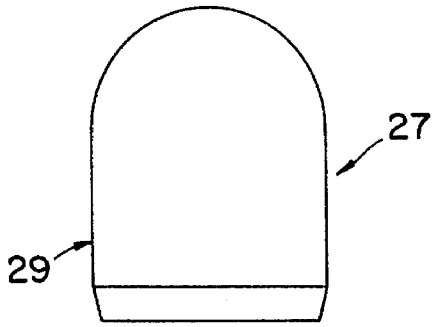
FIG. 7 is an elevational view of a dome-type insert fabricated in accordance with an embodiment of the present invention.
Figure 8:
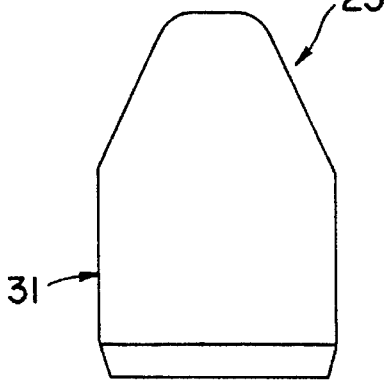
FIG. 8 is elevational view of a chisel-type insert fabricated in accordance with an embodiment of the present invention.

Preferred embodiments of the present invention are shown in FIGS. 3–8. The inventive insert may be of the dome-type 27 or chisel-type 25, as seen in FIGS. 7 and 8, respectively. As shown in FIGS. 7 and 8, each dome-type insert 27 and chisel-type insert 25 includes a cylindrical base 29 and 31, respectively, which is adapted to be press fitted in an opening, sometime referred to as a socket, in the face of the lower end of the percussion or rotary bit body, respectively.

Figure 3:
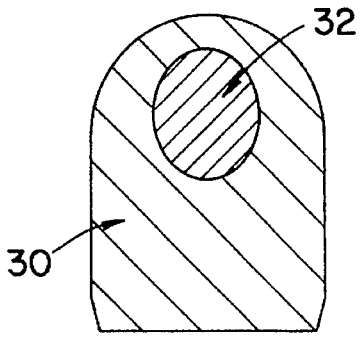
FIG. 3 is a longitudinal sectional view of a dome-type insert fabricated in accordance with one embodiment of the present invention.
Figure 4:
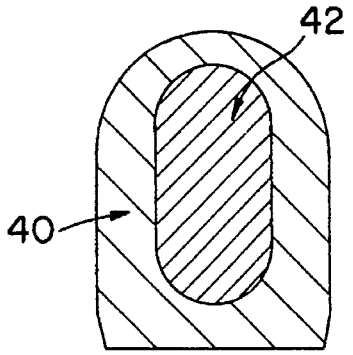
FIG. 4 is a longitudinal sectional view of a dome-type insert fabricated in accordance with another embodiment of the present invention.

The preferred embodiment of the present invention shown in FIG. 3 is a dome-type insert having an outer body or portion 30 and a spherical encapsulated inner body or core 32. The embodiment shown in FIG. 4 is a dome-type insert having an outer portion body or portion 40 and an oblong encapsulated inner body or core 42. The alternate embodiment shown in FIG. 5 is a chisel-type insert having an outer body or portion 50 and a spherical encapsulated inner body or core 52. FIG. 6 shows yet another embodiment of the present invention having an outer body or portion 60 and an oblong encapsulated inner body or core 62. Another alternate embodiment of the present invention may have a partially encapsulated inner body surrounded at the top sides by an outer body. This embodiment may be desirable under particular drilling circumstances.

The outer body and encapsulated inner body of each insert is formed of particles of carbide or other highly abrasive materials and a binder of cobalt or a binding metal from the iron group, as well known in the art. Carbides which may be used include tungsten carbide, titanium carbide, and molybdenum carbide. Other carbides suitable for preparing embodiments of the inventive insert will be known to those skilled in the art.

The preferred embodiments of the present invention shown in FIGS. 3–6 have an outer body and an encapsulated inner body comprising a tungsten carbide material, wherein the outer portion is harder and more wear resistant as compared to the encapsulated inner body, which is less wear resistant, but tougher. At least two factors which determine the relative toughness and wear resistance characteristics of tungsten carbide are: (1) the cobalt content of the tungsten carbide material, where the harder, more wear resistant material has less cobalt and where the softer, but more tough material has more cobalt; and (2) the grain size of the tungsten carbide material, where the harder, more wear resistant material has a relatively small grain size and where the softer, more tough material has a relatively large grain size.

In a preferred embodiment of the present invention, the outer body of the insert will be comprised of a tungsten carbide material having an average grain size of approximately 1 to 3 microns and contain 6% by weight of a cobalt binder. The encapsulated inner body will be comprised of a tungsten carbide material having an average grain size of approximately 5 to 7 microns and contain approximately 10% by weight of a cobalt binder.

The inner body is formed first and compressed at a range of approximately 5 to 15 tons per square inch to form a first homogeneous body of material. The encapsulated inner body should not exceed 30% by weight of the total weight of the insert. The outer body is then formed around the bolus-like inner body or core, and the inner body and outer body are compressed at a range of approximately 10 to 25 tons per square inch, thereby forming a second homogeneous body of material around the first body. The outer body of the insert thus encapsulates the inner body so that it will be of at least approximately equal thickness around the inner body at the cutting surface to thereby ensure even wear. The shock resistance of the harder, more wear resistant outer body is improved as a result of it surrounding the tougher inner body. The compressed insert, having an outer body with its encapsulated inner body, is then sintered. Following sintering, there is no distinct separation or interface or layer of any kind between the outer body and the encapsulated inner body, and there is no evidence of fracturing in the inner body. Thus, the sintered insert appears to be metallurgically bonded with a minimal amount of cobalt migration from the inner body to the perimeter of the outer body, therefore, the cobalt content in each body remains substantially constant.

In a preferred embodiment of the invention, the outer body of the insert will have a Rockwall hardness (Ra) of from between approximately 91 and 93, and the encapsulated inner body will have a Rockwall hardness of from between approximately 87 and 89. While the relative hardness of the outer portion is higher than the encapsulated inner body, the toughness of the encapsulated inner body is relatively greater. In particular, the toughness of the encapsulated inner body, as measured by transverse rupture strength (TRS), measured in pounds per square inch (psi), is approximately 430,000 psi, while the TRS of the outer body is approximately 340,000 psi.

It will be understood that the construction of the inserts above-described, are merely illustrative, and that the other constructions having other wear surface configurations are also anticipated by the present invention.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A method for forming a hard metal insert for being accommodated within a socket opening of a drill bit and having a cutting tip projecting therefrom, comprising creating a first mixture of a carbide material and a binder material suitable for making an inner body of the insert, creating a second mixture of a carbide material and a binder material suitable for making an outer body of the insert wherein said inner body mixture is comprised of material having a particle grain size and/or chemical composition with respect to said outer body mixture to establish the inner body as tougher than the outer body and to establish the outer as harder than the inner body, compressing the first mixture to form a homogeneous inner body, encapsulating the inner body within the second mixture so that the outer body is homogeneous and of at least approximately equal thickness around the inner body at the cutting tip of the insert, and sintering the insert so that the homogenous materials of the inner and outer bodies blend together without a distinct separation or interface layer therebetween.

2. The method as set forth in claim 1, wherein said particle grain size of the mixture of the homogeneous inner body is larger than the particle grain size of the mixture of the homogeneous outer body.

3. The method as set forth in claim 1, wherein the binder material content of the mixture of the homogeneous inner body is higher than the binder material content of the mixture of the homogeneous outer body.

4. The method as set forth in claim 1, wherein the outer body mixture comprises a tungsten carbide material having an average grain size in the range of approximately 1 to 3 microns.

5. The method as set forth in claim 1, wherein the inner body mixture comprises a tungsten carbide material having an average grain size in the range of approximately 5 to 7 microns.

6. The method as set forth in claim 1, wherein the outer body mixture is comprised of approximately 6% cobalt.

7. The method as set forth in claim 1 or 2, wherein the inner body mixture is comprised of approximately 10% cobalt.

* * * * *